US005261642A

United States Patent [19]

Stambaugh

[11] Patent Number: 5,261,642

[45] Date of Patent: Nov. 16, 1993

[54] STEEL POST PULLER

[76] Inventor: Darrell G. Stambaugh, RR-2 Box 17, Glenburn, N. Dak. 58740

[21] Appl. No.: 5,394

[22] Filed: Jan. 15, 1993

[51] Int. Cl.[5] ..... E21B 19/00

[52] U.S. Cl. ..... 254/30

[58] Field of Search ..... 254/29 R, 30-31, 254/132; 294/90, 91, 102.1, 102.2, 103.1, 104, 113, 114

[56] References Cited

U.S. PATENT DOCUMENTS

| | | | |
|---|---|---|---|
| 333,577 | 1/1886 | Watson | 254/31 |
| 785,801 | 3/1905 | Davis et al. | 254/132 |
| 1,107,955 | 8/1914 | James | 254/31 |
| 1,277,906 | 9/1918 | Gilborne | 254/31 |
| 1,666,454 | 4/1928 | Johnson | 254/132 |
| 4,040,601 | 8/1977 | Boardman . | |
| 4,161,310 | 7/1979 | Parker . | |
| 4,422,621 | 12/1983 | Ekern . | |
| 4,726,565 | 2/1988 | Keller . | |
| 4,738,433 | 4/1988 | Hoff . | |
| 5,022,632 | 6/1991 | Beideck . | |

*Primary Examiner*—Robert C. Watson

*Attorney, Agent, or Firm*—Jacobson, Price, Holman & Stern

[57] ABSTRACT

A generally rectangular upright sleeve is provided for downward telescoping over a metal fence post of the type that is generally T-shaped in cross section. The sleeve includes interior structure which enables the sleeve to slide downwardly along the associated fence post but releasably prevents upward movement of the sleeve along the fence post thereby enabling an upward thrust on the sleeve to be transferred to the post for pulling the post from the ground.

7 Claims, 2 Drawing Sheets

STEEL POST PULLER

BACKGROUND OF THE INVENTION

1. Field of the Invention

This invention relates to a puller which may be telescoped downwardly over a ground embedded steel post to a selected level thereon, engaged with the post by a slight upward shifting therealong and then have a heavy lifting force applied thereto either by a jack or by a lift in order to pull the post from the ground.

2. Description of Related Art

Various different forms of steel and other post pullers heretofore have been provided and more specifically post pullers designed primarily for use in conjunction with steel posts which are T-shaped in cross section and have outward projecting abutments or lugs carried by the face of the flange of the post remote from the shank or spine thereof.

Examples of these previously known forms of post pullers are disclosed in U.S. Pat. Nos. 4,040,601, 4,161,310, 4,422,621, 4,738,433, 4,726,565 and 5,022,632. However, these previously known forms of post pullers do not include the overall combination of structural features of the instant invention which result in a post puller which may be more positively engaged with a post to be pulled from the ground, which may have a strong lifting force applied thereto either by a jack structure or by a cable lift and which may exert a substantially vertical upward pull on the associated post, all while enabling the puller to be readily varied in position along the post to be pulled in relation to ground level.

SUMMARY OF THE INVENTION

The post puller of the instant invention includes an upstanding sleeve which may be telescoped downwardly over a metal fence post to any level thereon and thereafter slightly upwardly displaced relative to the fence post in order to interlock the sleeve with the fence post whereby an upward force may be applied to the sleeve for pulling the fence post from the ground. The puller is designed specifically for use in conjunction with metal fence posts which are T-shaped in cross section and which include vertically spaced outwardly projecting lugs or abutments on the face of the flange thereof remote from the spine or stem of the post.

The post puller engages an associated T-shaped post in a manner such that upward force applied to the puller either through the utilization of a ground abutted jack or a lifting cable will exert a substantially vertical upward thrust on the associated fence post to assist in pulling the latter upwardly from the ground. Still further, the post puller also may be utilized for quickly and efficiently raising a post relative to the ground without pulling the post from the ground, as is sometimes required.

The main object of this invention is to provide a fence post puller which may be used in conjunction with various force generating structures such as jacks, levers and hoists for removing metal post from the ground.

Yet another object of this invention is to provide a fence post puller which may be readily engaged with a fence post to be pulled from the ground to a predetermined level on the fence post and have force generating structure operatively associated with the puller for pulling the associated fence post from the ground.

Still another very important object of this invention is to provide a fence post puller which may be utilized to adjustably raise a fence post relative to the ground without completely removing the post from the ground.

A further object of this invention is to provide a fence post puller which is adapted for use in conjunction with T-cross section metal fence posts of various different manufacturers.

A final objection of this invention to be specifically enumerated herein is to provide a fence post puller in accordance with the preceding objects and which will conform to conventional forms of manufacturer, be of simple construction and easy to use so as to provide a device that will be economically feasible, and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
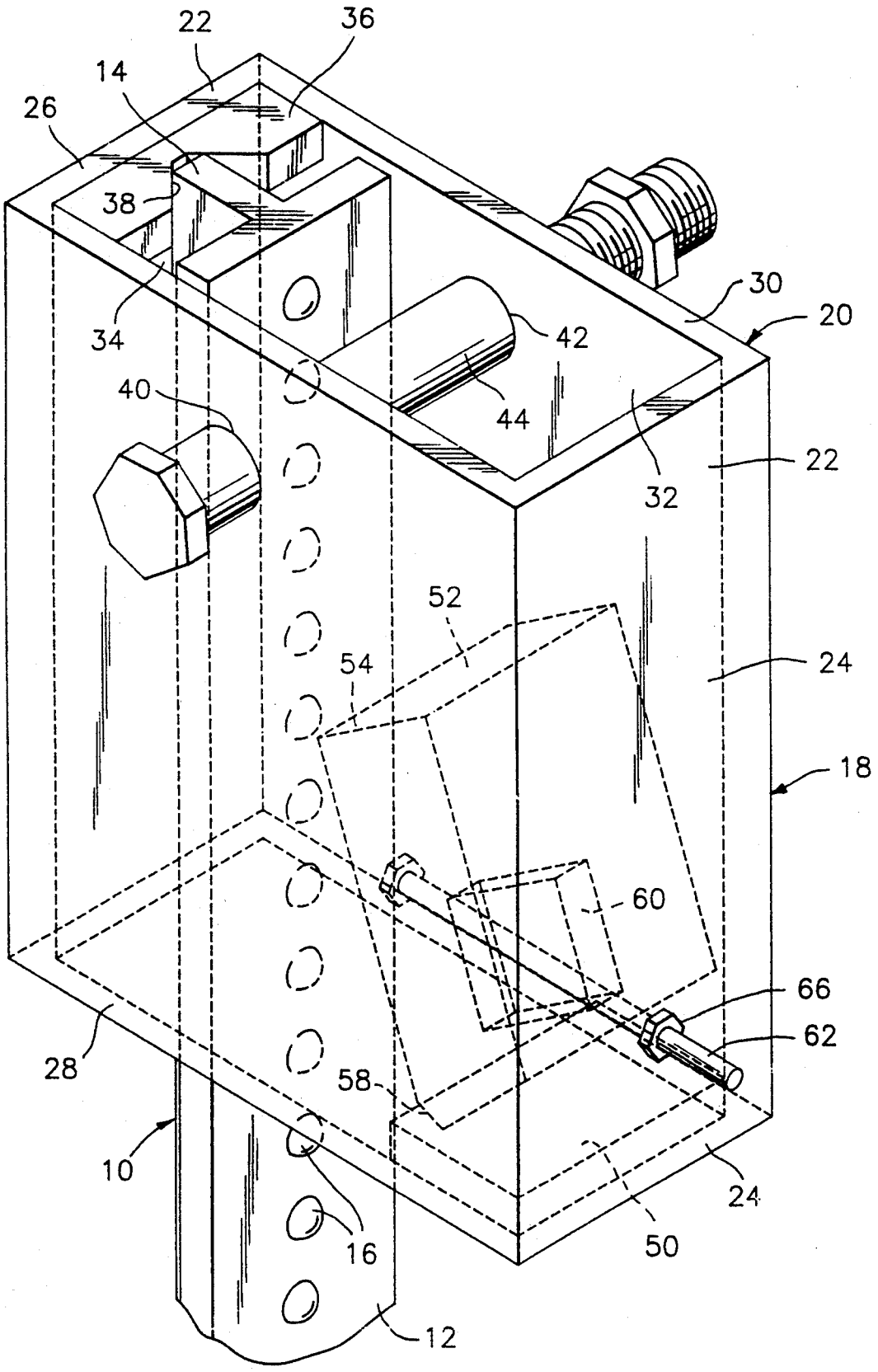
FIG. 1 is a fragmentary prospective view of the upper end of a typical T-shaped cross section metal fence post with the post puller illustrated in operative association therewith.
Figure 3:
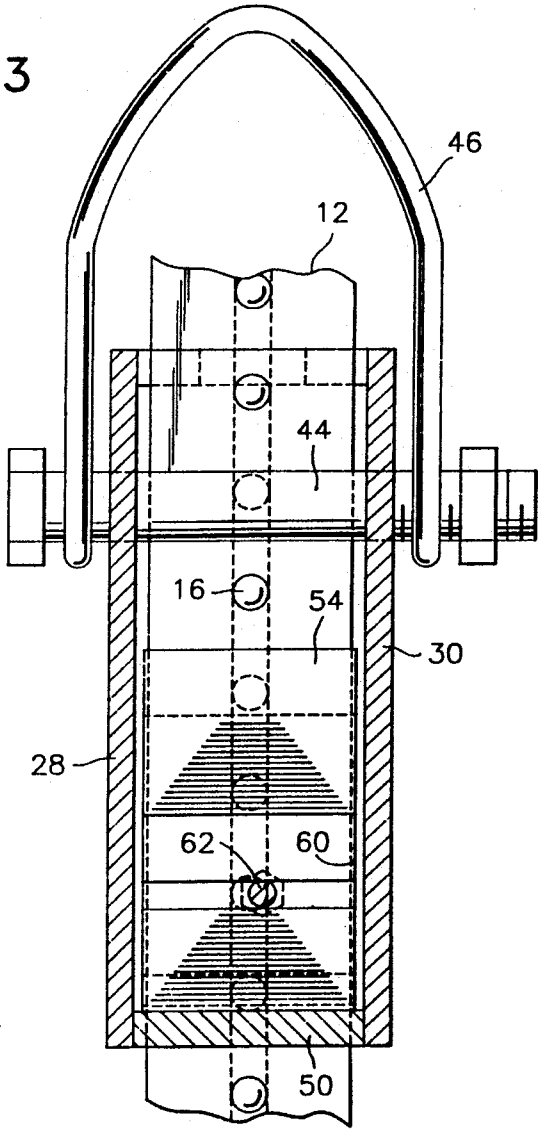
FIG. 3 is a vertical sectional view taken substantially upon the plane indicated by the section line 3—3 of FIG. 2.

Referring now more specifically to the drawings the numeral 10 generally designates a typical metal fence post which is substantially T-shaped in cross section and includes a face flange 12 and a stem 14. The face flange 12 includes a plurality of horizontally outstanding lugs 16 spaced therealong and the puller of the instant invention is referred to in general by the reference numeral 18 and engages the stem 14, the face flange 12 and the lugs 16 in order to transfer an upward thrust on the puller 18 to the fence post 10.

The puller 18 includes an upstanding rectangular sleeve referred to in general by the reference numeral 20 including upper and lower ends 22 and 24 and having opposite narrow sides 24 and 26 and opposite wide sides 28 and 30 extending between and interconnecting corresponding vertical margins of the narrow sides 24 and 26.

The sleeve 20 defines opposite interior zones 32 and 34 adjacent the narrow sides 24 and 26. The zones 32 and 34 extend the full vertical length of the sleeve 20 and the interior of the sleeve 20, at the upper end of the zone 34, includes an abutment lug 36 secured therein and extending thereacross between the wide sides 28 and 30, the lug 36 being rigidly attached to the wide sides 30 and 32 and also the narrow side 26.

The abutment lug 36 defines a horizontally opening notch 38 therein opening toward the zone 32 and narrow side 24 and the stem 14 of the post 10 is guideingly received through the notch 38. Further, the flange 12 is closely received between the inner surfaces of the wide sides 28 and 30, the adjacent portions of the post 16 being enclosed entirely within the zone 34 of the sleeve 20.

Upper portions of the wide sides 28 and 30, generally centrally intermediate the narrow sides 24 and 26, are provided with aligned bores 40 and 42 through which a lift shaft or bolt 44 is secured, the opposite ends of the bolt 44 projecting outwardly of the wide sides 28 and 30 whereby a lifting bail 46 may be mounted on the extended ends of the bolt 44.

The lower end of the zone 32 is closed adjacent the narrow side 24 by an abutment member 50 secured to the inner surfaces of the narrow side 24 and the adjacent portions of the wide sides 28 and 30, the abutment member 50 comprising a rigid shelf.

A rectangular lift member or block 52 is provided and is disposed in upstanding position within the sleeve 20 including upper and lower ends 54 and 56. The lower end 56 is bevelled at approximately 45° as at 58 with the bevel 58 resting upon the abutment member or shelf 50. The lower portion of the lift member 52 includes a slot-type window 60 formed therethrough and a bolt type support member 62 is secured through an aperture 64 formed in the lower portion of the narrow side 24 through the utilization of a threaded nut 66. The support member 62 extends through the window 60 and loosely maintains the lift member 52 in the zone 32 above the shelf or abutment member 50. Further, the support member 62 limits tilting of the lift member 52 to a position slightly past the tilted position thereof illustrated in FIG. 2, the lift member also being swingable to a fully upright position immediately inward of the narrow side 24.

Figure 2:
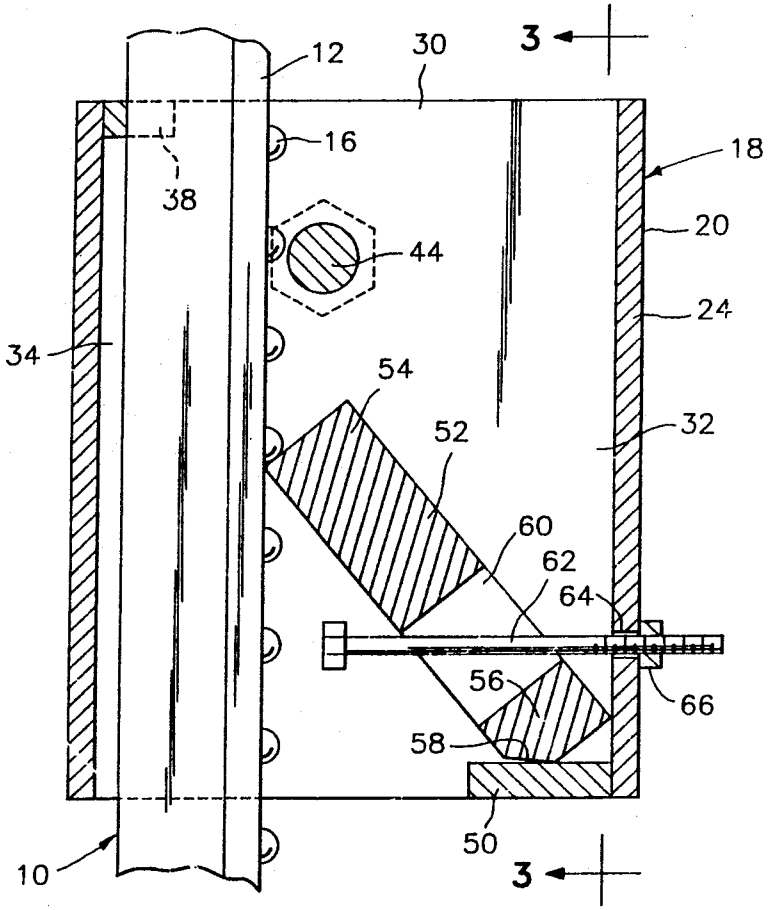
FIG. 2 is a reduced vertical sectional view of the assemblage illustrated in FIG. 1 with the post puller engaged with a lower portion of the fence post.

When the puller 18 is telescoped downwardly over the upper end of the post 10, the flange 12 and lugs 16 cam the lift member 52 from its fully tilted position to approximately the position thereof illustrated in FIG. 2 when the stem 14 is seated in the notch 38. The puller 18 then may be lowered downwardly along the post 10 to the desired position thereon and an upward force may be applied to the sleeve 20 either through the utilization of a hydraulic or mechanical jack engaged with the lower end of the sleeve 20, a lever engaged beneath the lower end of the sleeve 20 or a lifting cable or chain equipped with a hook engaged with the bail 46. Thereafter, as the puller 18 is urged upwardly, the upper end 54 of the lift member 52 engages the face of the flange 12 opposing the zone 32 and beneath the lug 16 immediately thereabove. In this manner, the lift member 52 experiences a nonslip engagement with the post 10 to transfer the upward thrust exerted on the sleeve 20 to the post 10 in order to elevate the latter relative to the ground in which the lower end of the post is embedded. The puller 18 may be used merely to slightly raise the post relative to the ground or, alternatively, to pull the post 20 fully from the ground.

Because of the fact that the post 10 is received in the zone 34 and is engaged in the notch 38 with the upper end 54 of the lift member 52 engaged with the flange 12 and a selected abutment 16, an upward thrust on the sleeve 20 functions to transfer an almost vertical upward thrust on the post 10. This is true even through a lifting cable engaged with the bail 46 is inclined appreciable relative to the sleeve 20.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalence may be resorted to, falling within the scope of the invention.

What is claimed as new is as follows:

1. A metal fence post puller including an upright rectangular sleeve having upper and lower ends and incorporating opposite narrow sides and opposite wide sides extending between and interconnecting said narrow sides, the interior of said sleeve defining opposite interior zones adjacent said narrow sides, said puller, in a first of said zones, defining a central notch opening toward the opposite zone for guiding action on the stem of a T-shaped post extending upwardly through said first zone with a lug equipped flange of said post facing toward said opposite zone, an elongated upstanding flange lug engageable lift member having upper and lower ends mounted in said opposite zone for movement between a first substantially upright position and a second inclined position with said upper end of said lift member swung toward said one zone, the portion of said lift member upper end opposing said one zone being adapted to engage said flange immediately beneath a lug thereof, said lift member being supported in said opposite zone in a manner limiting downward shifting of said lift member relative to said sleeve, a lift shaft secured through said wide sides adjacent said sleeve upper end generally centrally intermediate said narrow sides.

2. The puller of claim 1 wherein said central notch is defined in an abutment lug secured across said first zone adjacent the upper end of said sleeve.

3. The puller of claim 1 wherein said lift shaft is spaced above said lift member.

4. A metal fence post puller including an upright rectangular sleeve having upper and lower ends and incorporating opposite narrow sides and opposite wide sides extending between and interconnecting said narrow sides, the interior of said sleeve defining opposite interior zones adjacent said narrow sides, said puller, in a first of said zones, defining a central notch opening toward the opposite zone for guiding action on the stem of a T-shaped post extending upwardly through said first zone with a lug equipped flange of said post facing toward said opposite zone, an elongated upstanding flange lug engageable lift member having upper and lower ends mounted in said opposite zone for movement between a first substantially upright position and a second inclined position with said upper end of said lift member swung toward said one zone, the portion of said lift member upper end opposing said one zone being adapted to engage said flange immediately beneath a lug thereof, said lift member being supported in said opposite zone in a manner limiting downward shifting of said lift member relative to said sleeve, said sleeve including a generally horizontal abutment member adjacent the lower end of said sleeve and at least closely adjacent the corresponding narrow side, of the lower end of said lift member being rockably supported from said abutment member and closely received between said wide sides.

5. The puller of claim 4 wherein said lift member defines a window extending generally horizontally therethrough along a path extending between said narrow sides, and a support member supported from said corresponding narrow side and extending loosely through said window for support of said lift member therefrom.

6. The puller of claim 5 wherein said support member is removably supported from said corresponding narrow side.

7. The puller of claim 5 wherein said window is of a width transversely of said lift member to closely receive said support member therethrough and of a height measured along the length of said lift member whereby engagement of said support member with the lower extremity of said window adjacent said corresponding narrow side and with the upper extremity of said window adjacent said one narrow side limits tilting of said lift member to a position inclined less than 45° relative to said sleeve.

* * * * *